United States Patent [19]

Nichols

[11] Patent Number: 4,667,557

[45] Date of Patent: May 26, 1987

[54] DETACHABLE LOCKING SYSTEM FOR THE FALLBOARD OF A KEYBOARD MUSICAL INSTRUMENT

[76] Inventor: Roger H. Nichols, 5535 Hazeltine Ave., Van Nuys, Calif. 91401

[21] Appl. No.: 859,607

[22] Filed: May 5, 1986

[51] Int. Cl.[4] ..... G10C 3/02

[52] U.S. Cl. ..... 84/179

[58] Field of Search ..... 84/177–183, 84/453

[56] References Cited

U.S. PATENT DOCUMENTS 1,050,507 1/1913 Feidler ..... 84/179

4,040,375 8/1977 Oliver et al. ..... 84/183

*Primary Examiner*—Benjamin R. Fuller

*Attorney, Agent, or Firm*—James H. Phillips

[57] ABSTRACT

A locking accessory for preventing unauthorized access to a high grade keyboard musical instrument is disclosed. The locking accessory includes a stationary shoe element permanently secured to the bottom surface of the instrument keybed and a generally C-shaped element adapted to be removably affixed and locked to the stationary element. The C-shaped element includes generally horizontal upper and lower sections connected by a generally vertical intermediate section. The lower section is adapted to slidably engage the stationary element such that the upper section, supported by the intermediate section, extends over and just above the closed fallboard, thereby preventing it from being opened. The lower section includes a lock and bolt assembly which, when actuated, moves a bolt into engagement with a corresponding bolt receiving aperture in the stationary element to permit securely locking the stationary and C-shaped elements together. A resilient coating on the inner surfaces of the C-shaped element serve to protect the fallboard finish from being marred.

8 Claims, 6 Drawing Figures

DETACHABLE LOCKING SYSTEM FOR THE FALLBOARD OF A KEYBOARD MUSICAL INSTRUMENT

FIELD OF THE INVENTION

This invention relates to the musical instrument arts and, more particularly, to a system for locking the fallboard of a keyboard instrument.

BACKGROUND OF THE INVENTION

Most keyboard musical instruments are provided with a fallboard which may be closed to conceal the keyboard when the instrument is not being used. When the fallboard is closed, the keyboard is protected from the long term effects of dust and other airborne pollutants and even light which can cause the white keys to yellow over a period of years. It is also the intent of a closed fallboard to protect the keyboard and the instrument itself from such serious accidents as spilled drinks, cigarette burns, etc. Further, in the case of high grade instruments such as concert grand pianos, it is also desirable to prevent unauthorized access to the keyboard not only for the reasons previously mentioned, but also to simply maintain the instrument in concert tune and regulation. Thus, those skilled in the art are very much aware of the value of the fallboard, particularly in high grade instruments, and most instruments include integral means for locking the fallboard in a closed position since it is otherwise easily opened. However, as a practical matter, the keys to these built-in fallboard locks are often promptly lost, and as a result, these locks are rarely used. Further, the built in locking systems are most often very simple in nature and easily defeated.

Therefore, those skilled in the art will appreciate that it would be highly desirable to provide a very secure fallboard locking system (which may be nonetheless readily actuated to unlock the instrument for a concert) to protect the keyboard of a high grade instrument such as a concert grand piano which is intended to be maintained in a concert ready condition. It is to these and other ends that my invention is directed.

OBJECTS OF THE INVENTION

It is therefore a broad object of my invention to provide an improved fallboard locking system for a keyboard musical instrument.

It is another object of my invention to provide such a fallboard locking system which is very secure, but which may be easily and quickly unlocked to permit authorized use of the instrument.

In another aspect, it is an object of my invention to provide such a fallboard locking system which may be readily integrated into a high grade instrument without detracting from the instrument's appearance or in any way interfering with the use of the instrument by an artist.

SUMMARY OF THE INVENTION

These and other objects of my invention are achieved with a locking accessory consisting of a stationary shoe element permanently secured to the bottom surface of the instrument keybed and a generally C-shaped element adapted to be removably affixed and locked to the stationary element. The C-shaped element includes generally horizontal upper and lower sections connected by a generally vertical intermediate section. The lower section is adapted to slidably engage the stationary element such that the upper section, supported by the intermediate section, extends over and just above the closed fallboard, thereby preventing it from being opened. The lower section preferably includes a lock and bolt assembly which, when actuated, moves a bolt into engagement with a corresponding bolt receiving aperture in the stationary element to permit securely locking the stationary and C-shaped elements together.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE INVENTION

Figure 1:
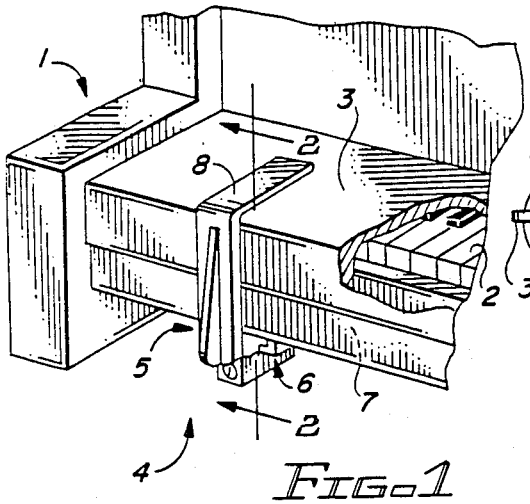
FIG. 1 is a partial view of a piano particularly illustrating one end of the keyboard with the fallboard closed and incorporating a fallboard locking assembly according to the present invention.

Referring now to FIG. 1, there is shown a partial view of a piano 1 (employed herein as an exemplary keyboard instrument) having a keyboard 2 covered by a closed fallboard 3. As illustrated in FIG. 1, the fallboard 3 cannot be opened because of the pressure of the fallboard locking assembly, generally indicated at 4, according to the present invention. As will become more apparent from the discussion below, the fallboard locking assembly 4 constitutes a generally C-shaped removable element 5 which is detachably coupled to a stationary shoe element 6 which is affixed to the bottom of the keybed 7. When the C-shaped element 5 is coupled to the stationary element 6 as shown in FIG. 1, an upper section 8 of the C-shaped element extends over the fallboard 3 to prevent it from being opened. Alternatively, when the C-shaped element 5 has been decoupled from the stationary element 6, the fallboard may be freely opened to gain access to the instrument keyboard 2.

Figure 3:
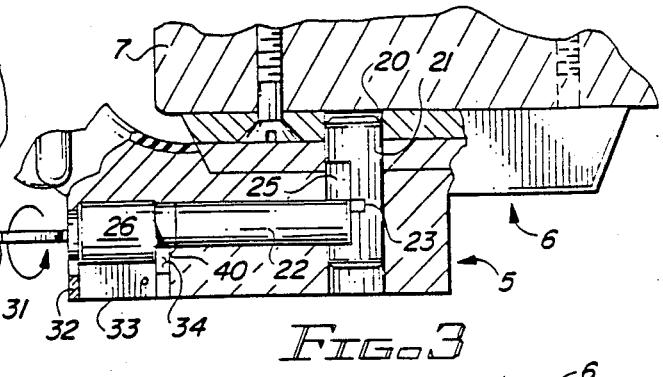
FIG. 3 is a partially cut-away partial view illustrating the lower region of the C-shaped element and the stationary element as they are coupled and locked together.
Figure 2:
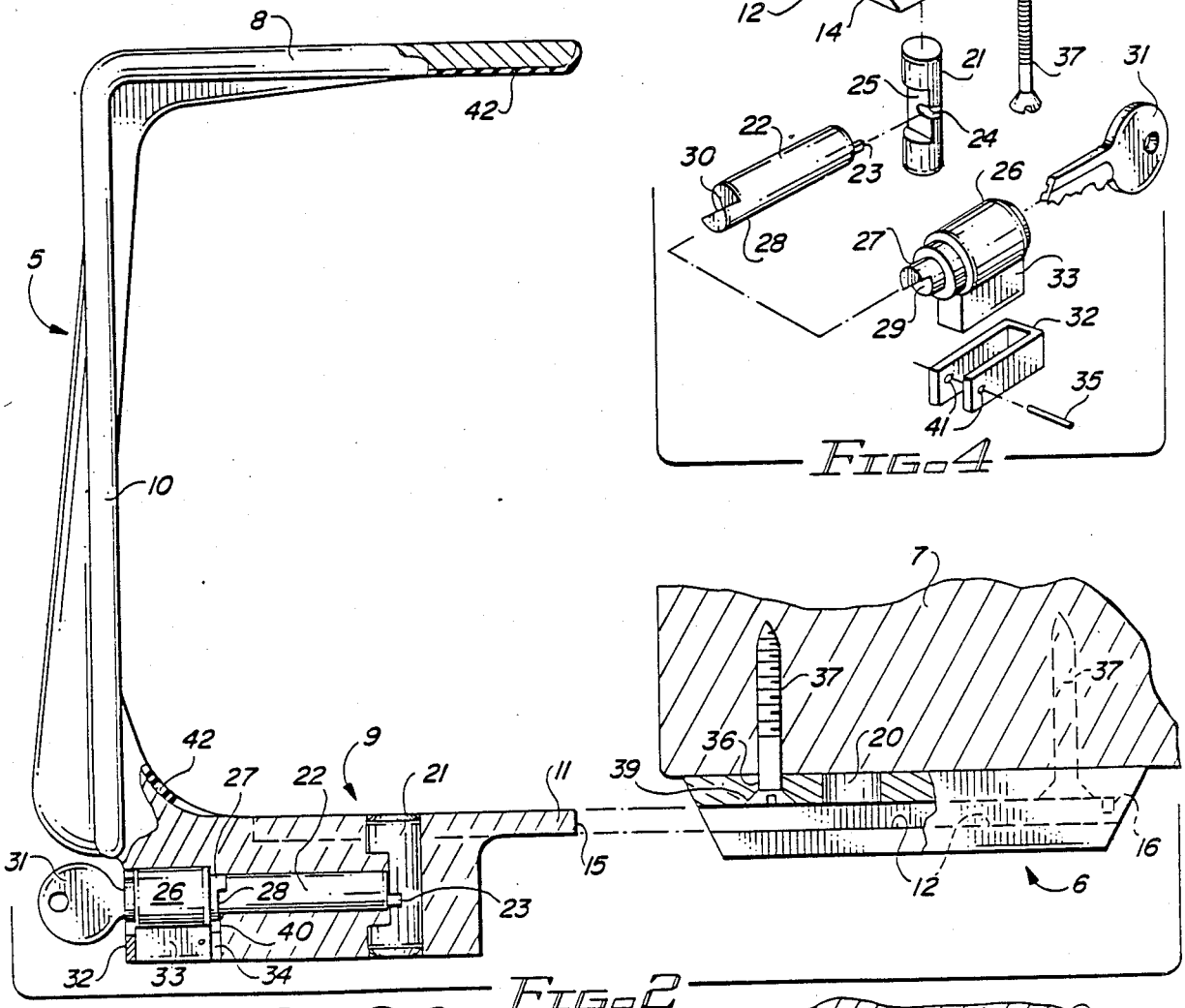
FIG. 2 is a partially cut-away view taken along the lines 2—2 of FIG. 1 and particularly illustrating a C-shaped removable element of the assembly and also illustrating the manner in which the C-shaped element may be coupled to a stationary shoe element of the assembly.
Figure 5:
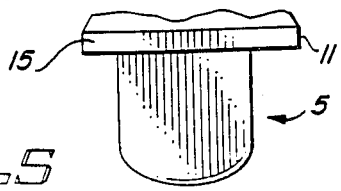
FIG. 5 is a partial rear view of the lower region of the C-shaped element of the assembly.
Figure 6:
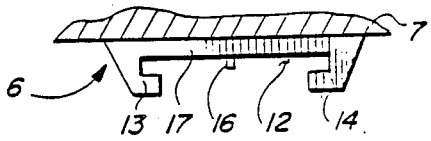
FIG. 6 is a front view of the stationary element of the assembly particularly illustrating a slot for receiving a corresponding slot engaging section of the C-shaped element to effect the coupling and decoupling between the two elements constituting the assembly.

The structural and operational details of the C-shaped element 5 and the stationary element 6 and the detachable coupling relationship between them may best be appreciated with reference to FIGS. 2 and 3. More particularly, as best shown in FIG. 2, the C-shaped element 5 includes the upper section 8, a lower section 9, and a vertical intermediate section 10 connecting the upper and lower sections. In a presently preferred embodiment, the upper and lower sections 8 and 9 extend generally parallel to one another with the intermediate element 10 disposed generally perpendicular to effect the side of the "C". The lower section 9 includes an upper ledge 11 which is dimensioned and configured to closely fit into an elongated guide slot 12 in the stationary element 6. The guide slot 12 is disposed generally parallel to the lower surface of the keybed 7 and extends fore and aft with respect to the keyboard depth. As best shown in FIGS. 5, 6, the guide slot 12 is open bottomed, but support for the edges of the ledge 11 is provided by inwardly directed tangs 13, 14 which extend toward one another across the open bottom of the slot 12. Thus, the ledge 11 may be inserted into the slot 12 and pushed rearwardly until the front edge 15 of the ledge abuts a stop 16 situated near the rearward terminus of and depending downwardly into the slot 12 from the upper section 17 of the stationary element 6.

Figure 4:
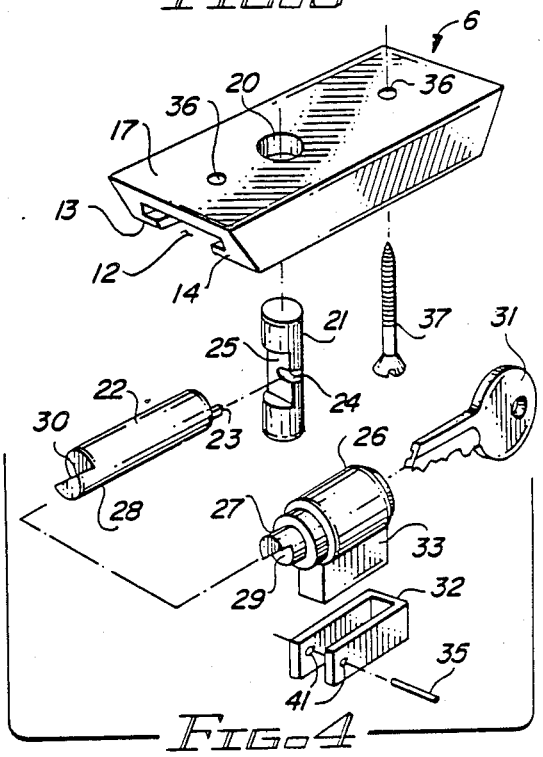
FIG. 4 is an exploded view illustrating the locking and motion transmitting elements of a bolt assembly by which the C-shaped element may be locked to the stationary elements.

Thus, when the C-shaped element 5 and the stationary element 6 are coupled together and the C-shaped element has been pushed to its rearmost position as defined by the stop 16, the juxtaposition illustrated in FIG. 3 is obtained. In this position, a vertically disposed bolt receiving aperture 20 provided through the upper section 17 of the stationary element 6 is vertically aligned with a vertically translating bolt 21 carried in the lower section 6 of the C-shaped element 5. Referring to FIG. 4 as well as FIGS. 2 and 3, the vertical position of the bolt 21 is determined by the angular position of a shaft 22 which carries an eccentric pin 23 at its outboard end. The pin 23 extends forwardly to engage a pin-receiving slot 24 provided within a longitudinal notch 25 in the bolt 21. As will be apparent from FIGS. 2 and 3, the notch 25 receives the end of the shaft 22 carrying the eccentric pin 23 and provides clearance for the vertical movement of the bolt 21.

The shaft 22 is rotatably actuable by the operation of a cylinder lock mechanism 26 which has a rotary drive output member 27 coaxially aligned with the shaft 22 and configured to engage the drive end 28 of the shaft 22. As best shown in FIG. 4, the drive member 27 and the shaft 22 are the same diameter, and the driving engagement is effected by respective diametrically relieved regions 29, 30 which cooperate such that the drive member 27 and the end 28 of the shaft 22 engage to provide overlapping shoulders across their respective diameters through which the rotary motion of the drive member 27 is communicated to the shaft 22.

The lock mechanism 26 may be of any suitable type for providing the requisite rotary output in response to turning a key 31. Thus, FIG. 2 illustrates the lock mechanism in the unlocked position in which the eccentric pin 23 has pulled the bolt 21 downwardly to permit insertion or removal of the C-shaped element 5 into the stationary element 6. Conversely, FIG. 3 illustrates the C-shaped element 5 coupled to and locked to the stationary element 6, a condition established by pushing the C-shaped element rearwardly until it abuts the stop 16 (FIGS. 2 and 6) such that, as previously discussed, the bolt 21 and the bolt receiving aperture 20 are in vertical alignment. Thereafter, turning the key 31 rotates the shaft 22 such that the eccentric pin 23 drives the bolt 21 upwardly into the bolt receiving aperture 20 to lock the assembly together. The key may then be removed, and the fallboard 3 is securely locked to prevent access to the keyboard 2 as shown in FIG. 1.

The lock mechanism 26 is itself removably emplaced within the lower section 9 of the C-shaped element 5 by a small clevis 32 which is situated between the downwardly depending tab 33 of the lock mechanism 26 and the side walls 40 of a cavity 34 provided below the lock mechanism 26 and which is dimensioned and configured to receive the tab 33 and clevis 32 in frictional engagement. The clevis 32 may also be further secured by a pin 35 which extends through suitable aligned apertures in the side walls 40 and apertures 41 in the legs of the clevis. As a result, in an emergency in which the instrument must be used but the keys are unavailable, the clevis 32 may be pried out (after removing the pin 35 if provided) to permit withdrawal of the lock mechanism 26 and the shaft 22 which allows the bolt 21 to drop down into the unlocked position, thus permitting removal of the C-shaped element 5 to unlock the fallboard.

Two or more apertures 36 are provided through the upper section 17 of the stationary element 6 to receive wood screws 37 by which the stationary element is permanently affixed to the lower surface 38 of the keybed 7. Preferably, the apertures 36 are countersunk as at 39 to permit the use of flatheaded wood screws 37 for a compact and secure installation.

Because the fallboards of most keyboard musical instruments are finely finished wood, it is desirable to insure that the use of the locking assembly of the present invention (which is preferably fabricated from metal such as aluminum) does not damage the finish should an attempt be made to raise the fallboard when it is in place. A resilient coating 42 is preferably provided on the inner surfaces of at least the upper section 8 and the intermediate section 10 of the C-shaped element 5 to achieve this feature. One suitable material for the resilient coating 42 is RTV (room temperature vulcanizing) rubberized dip.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A locking assembly for a keyboard musical instrument including a fallboard and a keybed, said assembly comprising:

(A) a stationary element adapted to be permanently affixed to the lower surface of the instrument keybed, said stationary element including:

1. an elongated guide slot disposed generally parallel to said keybed lower surface and extending fore and aft with respect to the keyboard depth; and
2. a bolt receiving aperture opening into said guide slot; and (B) a generally C-shaped element adapted to be removably affixed to said stationary element, said C-shaped element comprising:

1. an upper section;
2. a lower section;
3. an intermediate section connecting said upper and lower sections such that said upper, lower and intermediate sections effect a combined "C" shape;

4. said lower section further comprising:

a. a ledge dimensioned and configured to closely fit into said guide slot of said stationary element;

b. a bolt adapted for reciprocal translation between a first, retracted position and a second, extended position, said bolt, when in said second position, extending into said bolt receiving aperture of said stationary element to lock said stationary element and said C-shaped element together; and c. bolt actuating means coupled to said bolt and adapted to admit manual actuation of said bolt to selectively move said bolt between said first and second positions;

whereby, when the instrument fallboard is closed and said C-shaped element is coupled to said stationary element by inserting said ledge into said guide slot, said C-shaped element upper section extends over the instrument fallboard and prevents it from being opened until said C-shaped element is subsequently decoupled from said stationary element.

2. The locking assembly of claim 1 in which said bolt actuating means includes:

A. a key driven locking mechanism coupled to said bolt; and

B. a key adapted for engagement with said locking mechanism;

such that turning said key to a first position moves said bolt to said first position and turning said key to a second position moves said bolt to said second position.

3. The locking assembly of claim 1 which further includes stop means extending into said elongated slot, said stop means being positioned within said elongated slot to abut said ledge when said ledge has been inserted into said slot and said bolt and said bolt receiving aperture are aligned.

4. The locking assembly of claim 2 which further includes stop means extending into said elongated slot, said stop means being positioned within said elongated slot to abut said ledge when said ledge has been inserted into said slot and said bolt and said bolt receiving aperture are aligned.

5. The locking assembly of claim 1 which further includes a resilient coating on at least inner surfaces of at least said upper and intermediate sections of said C-shaped element to protect the finish of the instrument fallboard.

6. The locking assembly of claim 2 which further includes a resilient coating on at least inner surfaces of at least said upper and intermediate sections of said C-shaped element to protect the finish of the instrument fallboard.

7. The locking assembly of claim 3 which further includes a resilient coating on at least inner surfaces of at least said upper and intermediate sections of said C-shaped element to protect the finish of the instrument fallboard.

8. The locking assembly of claim 4 which further includes a resilient coating on at least inner surfaces of at least said upper and intermediate sections of said C-shaped element to protect the finish of the instrument fallboard.

* * * * *